US009742079B2

(12) United States Patent
Martinez

(10) Patent No.: US 9,742,079 B2
(45) Date of Patent: Aug. 22, 2017

(54) CONNECTOR PAINT PROTECTION SHIELD

(71) Applicant: Cummins Inc., Columbus (IN)

(72) Inventor: Juan Carlos Martinez, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 15/156,778

(22) Filed: May 17, 2016

(65) Prior Publication Data

US 2016/0344114 A1 Nov. 24, 2016

Related U.S. Application Data

(60) Provisional application No. 62/165,035, filed on May 21, 2015.

(51) Int. Cl.

| | |
|---|---|
| ***H01R 4/28*** | (2006.01) |
| ***H01R 4/70*** | (2006.01) |
| ***H01R 43/00*** | (2006.01) |
| ***H01R 13/52*** | (2006.01) |

(52) U.S. Cl.
CPC ..... *H01R 4/70* (2013.01); *H01R 13/5213* (2013.01); *H01R 43/005* (2013.01)

(58) Field of Classification Search
CPC .... H01R 4/489; H01R 4/4863; H01R 4/5008; H01R 9/2408; A61N 1/048
USPC ..... 439/725, 607.4
See application file for complete search history.

(56) References Cited

U.S. PATENT DOCUMENTS

| | | | | |
|---|---|---|---|---|
| 2,877,437 | A * | 3/1959 | Flanagan, Jr. | H01R 13/6277 285/116 |
| 3,745,664 | A * | 7/1973 | Altseimer | H02G 3/14 220/3.4 |
| 3,917,372 | A * | 11/1975 | Selinko | H05K 5/0086 439/259 |
| 4,787,331 | A | 11/1988 | Jarvis | |
| 4,815,964 | A * | 3/1989 | Cohen | A61B 5/0408 600/392 |
| 5,003,128 | A * | 3/1991 | Grondin | B05B 15/045 118/505 |
| 5,285,014 | A * | 2/1994 | Gilchrist | B05B 15/045 118/505 |
| 5,295,872 | A * | 3/1994 | Christensson | A61N 1/048 439/822 |
| 6,223,088 | B1 * | 4/2001 | Scharnberg | A61N 1/046 439/909 |
| 6,298,548 | B1 * | 10/2001 | Suarez | H01R 43/01 29/566.3 |

(Continued)

*Primary Examiner* — Abdullah Riyami
*Assistant Examiner* — Vladimir Imas
(74) *Attorney, Agent, or Firm* — Foley & Lardner LLP

(57) ABSTRACT

An electrical wire connector includes a connector body having a first end engageable with one or more electrical wires and a second end removably engageable with a complementary end of a mating connector, the one or more electrical wires electrically bridgeable to one or more wires of the complementary connector when the connector body is engaged with the complementary connector. The electrical wire connector further includes a movable portion configured to selectively secure an engagement between the connector body and the complementary end of the mating connector, and a shield removably engaged to the connector body to cover a portion of the movable portion.

17 Claims, 4 Drawing Sheets

(56) References Cited

U.S. PATENT DOCUMENTS

| | | | | |
|---|---|---|---|---|
| 6,576,837 | B1 * | 6/2003 | Pimentel | H02G 3/14 174/58 |
| 6,780,065 | B2 * | 8/2004 | Schwarz | A61N 1/048 439/310 |
| 6,803,522 | B2 * | 10/2004 | Skakun | H02G 3/14 174/50 |
| 6,927,341 | B1 * | 8/2005 | Crane | H02G 3/14 16/DIG. 2 |
| 7,049,518 | B2 * | 5/2006 | Kimura | F04B 35/04 174/74 R |
| 7,071,413 | B1 * | 7/2006 | Paape | H02G 1/00 174/66 |
| 7,622,675 | B2 * | 11/2009 | Sutter | H02G 1/00 174/66 |
| 7,780,460 | B2 * | 8/2010 | Walter | H01R 4/363 439/81 |
| 8,771,000 | B2 * | 7/2014 | Melni | H01R 4/56 439/271 |
| 8,835,763 | B1 | 9/2014 | Hammond | |
| 9,184,512 | B2 * | 11/2015 | Duan | H01R 4/00 |
| 2014/0167696 | A1 * | 6/2014 | Kahara | B60L 11/1818 320/109 |

* cited by examiner

CONNECTOR PAINT PROTECTION SHIELD

CROSS-REFERENCE TO RELATED PATENT APPLICATIONS

This application claims the benefit of and priority to U.S. Provisional Patent Application No. 62/165,035 filed May 21, 2015, the contents of which are incorporated herein by reference in their entirety.

TECHNICAL FIELD

The present disclosure relates to internal combustion engines with electrical circuit connectors.

BACKGROUND

Internal combustion engines often include electrical systems with several interconnecting components. For example, a central processing unit can be electrically engaged to a variety of input devices (e.g., airflow sensors, pressure sensors, temperature sensors, and so on) and output devices (e.g., intake throttles, braking components, fuel pumps, and so on) through electrical wires. In the interest of being able to remove certain electrical or associated mechanical components (e.g., for replacement, servicing, or for accessing other components), electrical wires can be joined with one another via connectors.

Connectors can include exposed moving parts. For example, in the interest of avoiding accidental disconnections (e.g., as a result of worn out connectors, turbulence during operation, or an initial assembly process), a connector may include a mechanical locking device configured to secure a given wire connection. Where components are subject to a coating process (e.g., spraying or brushing paint, clear coat, or the like) during or after assembly of a given internal combustion engine, coating material may find its way into moving parts of a given mechanical locking device, possibly causing the mechanical locking device to seize.

SUMMARY

One embodiment relates to an electrical wire connector. The electrical wire connector includes a connector body, a movable portion, and a shield. The connector body includes a first end and a second end. The first end is engageable with one or more electrical wires and the second end is removably engageable with a complementary connector. The one or more electrical wires are electrically bridged to one or more wires of the complementary connector when the connector body is engaged with the complementary connector. The movable portion is disposed on the connector body. The shield is removably engaged to the connector body to cover a portion of the movable portion.

In some implementations, the movable portion includes a locking tab configured to selectively secure an engagement between the connector body and the complementary connector. In some implementations, the locking tab is movable from a first position to a second position. When the locking tab is in the first position, a first portion of the locking tab is covered by the shield. When the locking tab is in the second position, a second portion of the locking tab is covered by the shield. In some implementations, the second portion is larger than the first portion. In some implementations, a portion of the locking tab is linearly translatable into a locking device of the connector body. In some implementations, the locking tab is rotatable about an axis extending perpendicularly from the connector body. In some implementations, the locking tab is pivotable about a pivot point disposed on the connector body. In some implementations, the shield is removably engaged to the connector body via at least one clip. In some implementations, the shield is engaged to the connector body via an adhesive.

Another embodiment relates to a method of protecting an electrical wire connector. The method includes providing a shield removably engageable to a connector body of an electrical wire connector. The method further includes engaging the shield to the connector body at a location such that the shield covers the movable portion of the connector body. The method includes coating the electrical wire connector with a coating material such that the shield blocks coating material from being applied to the movable portion.

In some implementations, the movable portion includes a locking tab. In some implementations, the locking tab is movable from a first position to a second position. When the locking tab is in the first position, a first portion of the locking tab is covered by the shield. When the locking tab is in the second position, a second portion of the locking tab is covered by the shield. In some implementations, the second portion is larger than the first portion. In some implementations, a portion of the locking tab is linearly translatable into a locking device of the connector body. In some implementations, the locking tab is rotatable about an axis extending perpendicularly from the connector body. In some implementations, the locking tab is pivotable about a pivot point disposed on the connector body. In some implementations, the shield is removably engaged to the connector body via at least one clip. In some implementations, the shield is engaged to the connector body via an adhesive.

Another embodiment relates to an assembly that includes a connector and a shield. The connector includes a connector body having a first end engageable with one or more electrical wires and a second end removably engageable with a complementary connector. The one or more electrical wires electrically bridge to one or more wires of the complementary connector when the connector body is engaged with the complementary connector. The connector includes a locking device to selectively lock the connector body of the connector to the complementary connector. The connector also includes a locking tab movable from a first position to a second position. The connector body of the connector being not selectively locked to the complementary connector when the locking tab is in the first position, and the connector body being selectively locked to the complementary connector when the locking tab is in the second position. The shield is removably connectable to the connector body to cover the locking tab and the locking device of the connector. The shield includes a top cover, a first sidewall extending from the top cover, a second sidewall extending from the top cover, a first connecting portion hingedly coupled to the top cover, and a second connecting portion hingedly coupled to the top cover. The first connecting portion is moveable from a first position for the first connecting portion relative to the top cover to a second position for the first connecting portion relative to the top cover. The second connecting portion is moveable from a first position for the second connecting portion relative to the top cover to a second position for the second connecting portion relative to the top cover. The first connecting portion and the second connecting portion removably connect the shield to the connector body when the first connecting portion is in the second position for the first connecting portion relative to the top cover and the second connecting portion is in the second position for the second connecting portion relative to the top cover.

In some implementations, the first connecting portion includes one or more first latches and the second connecting portion includes one or more second latches.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF THE DRAWINGS

The skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar components).

The features and advantages of the inventive concepts disclosed herein will become more apparent from the detailed description set forth below when taken in conjunction with the drawings.

DETAILED DESCRIPTION

Following below are more detailed descriptions of various concepts related to, and embodiments of, wire connector shields and methods of coating wire connectors used in internal combustion engines. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Figure 1:
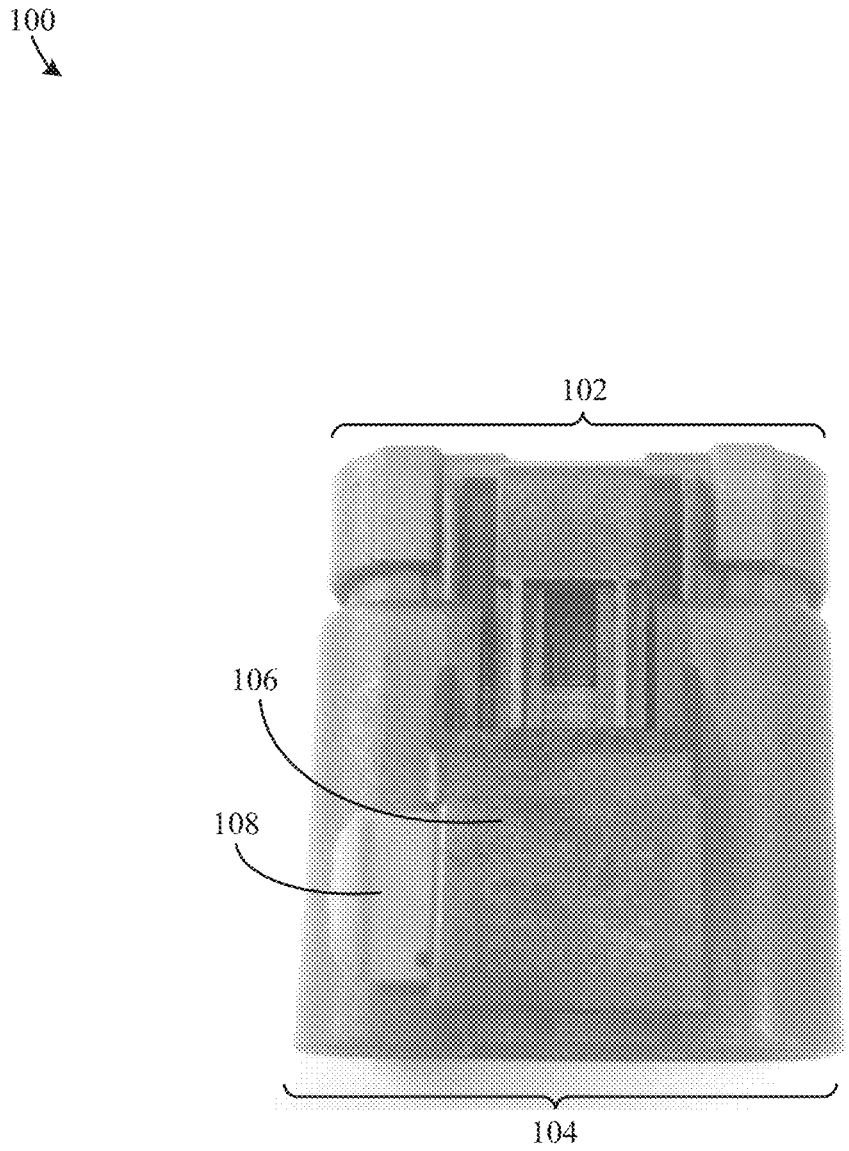
FIG. 1 is a top view of an electrical connector, according to an example embodiment.

Referring now to FIG. 1, a connector 100 is configured to removably engage with a corresponding mating connector (not shown). Each of the connector 100 and the mating connector are associated with one or more electrical wires that lead to and/or from various electrical devices disposed about and/or within an associated internal combustion engine. As one of ordinary skill in the relevant art would recognize, a wire as used in the context of the present disclosure may include any number and/or form of extensions of material capable of carrying electrical signals and that may be disposed within a sheath and/or a conduit.

The connector 100 includes a first end 102, a second end 104, and a locking device 106. The first end 102 is configured to receive and engage one or more electrical wires. For example, the first end 102 may be configured to removably receive and engage any of a several types of electrical wire terminals, including terminal clamps, segments of stripped wire, fork terminals, compression terminals, ring terminals, and so on. Alternatively, the first end 102 may be configured to more permanently receive and engage electrical wire terminals, for example the electrical wire terminals may be fixed within the first end 102 such as through soldered joints to one or more terminals within the first end 102.

The second end 104 of the connector 100 is configured to removably engage with a complementary end of the mating connector, thereby electrically coupling one or more terminals within the connector 100 with terminals of the mating connector. For example, where the connector 100 is configured to join the mating connector via a socket junction, the second end 104 may include a socket configured to removably receive and engage a corresponding plug disposed at the complementary end of the mating connector. Each of the socket and the plug may further include one or several terminal leads, such that each terminal lead is associated with one or more electrical wires. In such an example, coupling the socket at the second end 104 to the plug at the mating connector bridges electrical wires at the first end 102 of the connector 100 to electrical wires at the mating connector.

The locking device 106 selectively secures the engagement between the connector 100 to the mating connector. The mating connector may include a complementary locking component that assists the locking device 106 in the engagement. In some arrangements where the locking device 106 is in a configuration that secures the connector engagement, the connector 100 cannot be separated from the mating connector without excessive force and/or without damaging the connectors and/or the associated electrical wires. For example, the locking device 106 can cause a pin or slat disposed at one connector (e.g., the connector 100) to be inserted into a corresponding slot disposed at another connector (e.g., the mating connector). As another example, the locking device 106 can cause one connector (e.g., the mating connector) to clamp onto the other connector (e.g., the connector 100). Other mechanical locking devices may be used as well.

In some arrangements, the connector 100 includes an exposed moving portion, such as a locking tab 108. The locking tab 108 allows a user to physically cause the locking device 106 to secure the engagement of the connector 100 to the mating connector. In some arrangements, a user can slide the locking tab 108 into a first position, where the connector engagement is not secured (e.g., by pulling the locking tab 108 away from and out of the locking device 106), or slide the locking tab 108 into a second position, where the connector engagement is secured (e.g., by sliding the locking tab 108 towards and into the locking device 106). In other arrangements, the locking tab 108 may be configured to move by, for example, turning or rotating about an axis extending perpendicularly from the connector body, pivoting about a pivot point disposed on the connector body (e.g., a dial with a secured position and an unsecured position), or clamping (e.g., a spring loaded lever on one connector configured to clamp onto a complementary protrusion on another connector). As such, the locking tab 108 includes at least one moving portion (e.g., the portion of the locking tab 108 that translates or slides into the locking device 106, or the rotating aspect of a dial, or the pivot point of a lever, and so forth) that relies on being substantially unobstructed (e.g., having no or minimal material obstructing or resisting movement of the moving portion) in order to operate.

Figure 2A:
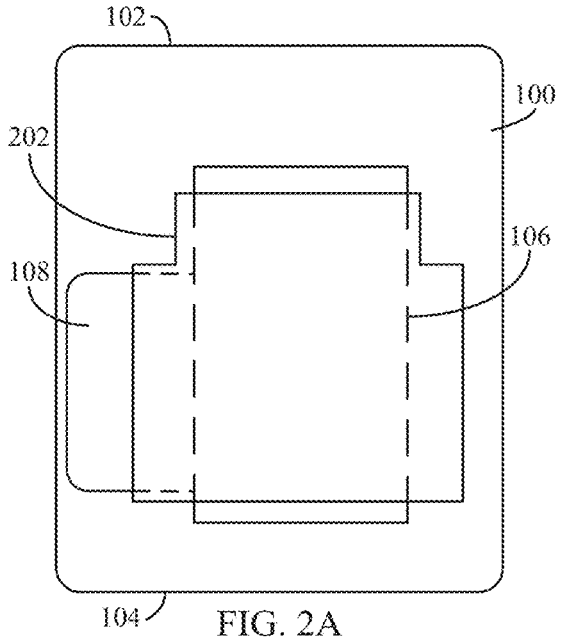
FIG. 2A is a schematic diagram of the electrical connector shown in FIG. 1 with a shield and a locking tab in a first position.

Referring now to FIG. 2A, a shield 202 may be removably engaged with the connector 100 to cover the moving portion, such as the locking tab 108. In some implementations, the shield 202 may be removably engaged during assembly of the connector 100 with a mating connector, transport of the connector 100, coating or painting of one or more components of the engine and/or device within which the connector 100 is being used, or in other situations. The shield 202 is a protective housing configured to complement and removably connect to one or more external features of the connector 100, to cover all or part of at least one exposed movable portion of the connector 100. The shield 202 may be made of any material capable of being formed in a manner sufficient to cover the moving portion of the connector 100. The shield 202 is composed of material sufficient to withstand environmental conditions incidental to both manufacturing an internal combustion engine (e.g., assembly, transport, etc.) and/or coating components thereof (e.g., painting and/or clear coating of one or more engine components and/or other components of the application into which the engine is being used, as well as a paint or clear coat drying stage). For example, the shield 202 may be composed of various plastics, metals, and/or alloys. In some arrangements, the shield 202 is removably engaged with the connector 100 via one or more clips formed on the shield 202 and is configured to engage one or more physical features of the connector 100 (e.g., protrusions, indents, trenches, the body of the connector 100 itself, or the like). In other arrangements, the shield 202 is removably engaged to the connector 100 via an adhesive. In some implementations, the shield 202 can be detachably integrally engaged to the connector 100, such as via an integral formation that can be broken apart from the connector 100.

For example, where the exposed movable portion is the locking tab 108, and the locking tab 108 is configured to translate into and out of the locking device 106, the shield 202 may be configured to cover an area of the connector 100 that includes at least portions of both the locking device 106 and the locking tab 108, as shown in FIG. 2A. In some such arrangements, the shield 202 is configured to cover a portion of the locking tab 108 that translates and is inserted into the locking device 106, along with an opening of the locking device 106 into which the locking tab 108 is inserted (e.g., as illustrated in FIG. 2A). In such an arrangement, the shield 202 may be configured to cover a first portion of the locking tab 108 that could cause the locking device 106 to seize upon engagement due to material or debris adhering to the locking tab 108 (e.g., if coated with paint or clear coat) when the locking tab 108 is in the first position, while exposing a second portion of the locking tab 108.

Figure 2B:
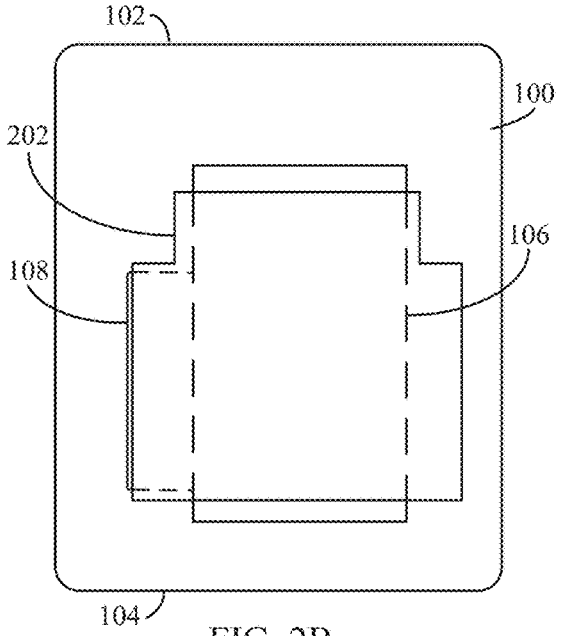
FIG. 2B is a schematic diagram of the electrical connector and shield shown in FIG. 2A, with the locking tab in a second position.

Referring now to FIG. 2B, the locking tab 108 is in the second position when the locking device 106 is engaged. The shield 202 may be configured to cover most or all of the locking tab 108 in the second position, and thus provides a visual indication regarding engagement of the locking tab 108. If the second portion of the locking tab 108 is substantially covered as illustrated in FIG. 2B, it is a visual indication that the locking tab 108 is engaged. If, however, the second portion of the locking tab 108 is partially exposed or fully exposed (e.g., as in FIG. 2A), it is a visual indication that the locking tab 108 is respectively not fully engaged, or is disengaged.

Figure 2C:
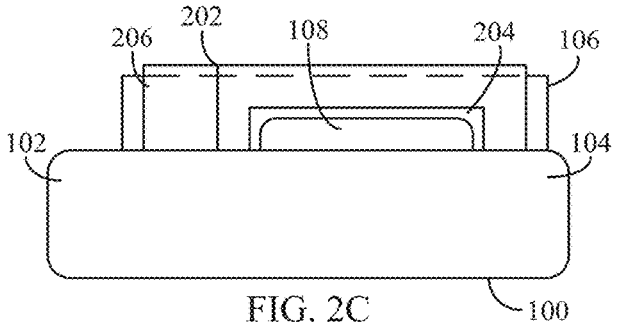
FIG. 2C is a side-view schematic diagram of the electrical connector and shield shown in FIGS. 2A and 2B.

Referring now to FIG. 2C, from a side view, the shield 202 may be configured to cover the locking device 106. The shield 202 is configured to cover most of the locking device 106 and, in some implementations, most of the locking tab 108 such that debris, paint, or other foreign material does not interfere with operation of the locking device 106 and/or locking tab 108. As shown, the shield 202 includes multiple wall portions 206 that extend from over the locking device 106 and down around the locking device 106 to where the locking device 106 meets the main body of the connector 100. The shield 202 may also include an aperture 204 through which a portion of the locking tab 108 may extend when the shield 202 is engaged to the connector 100 and the locking tab 108 is in the first position. The shield 202 can be engaged with the connector 100 via clips, clamps, snaps, adhesives, or other engagement feature. As shown, the aperture 204 is sized with a small tolerance about the locking tab 108 such that the locking tab 108 may be actuated from the first position to the second, locked position to lock the locking device 106 while the shield 202 remains engaged to the connector 100. The small tolerance between the wall portions 206 of the shield 202 and the locking tab 108 extending through the aperture 204 may limit the amount of foreign debris that can enter into the locking device 106 and/or adhere to the locking tab 108 to affect operation of the locking device 106 and/or the locking tab 108.

Figure 3:
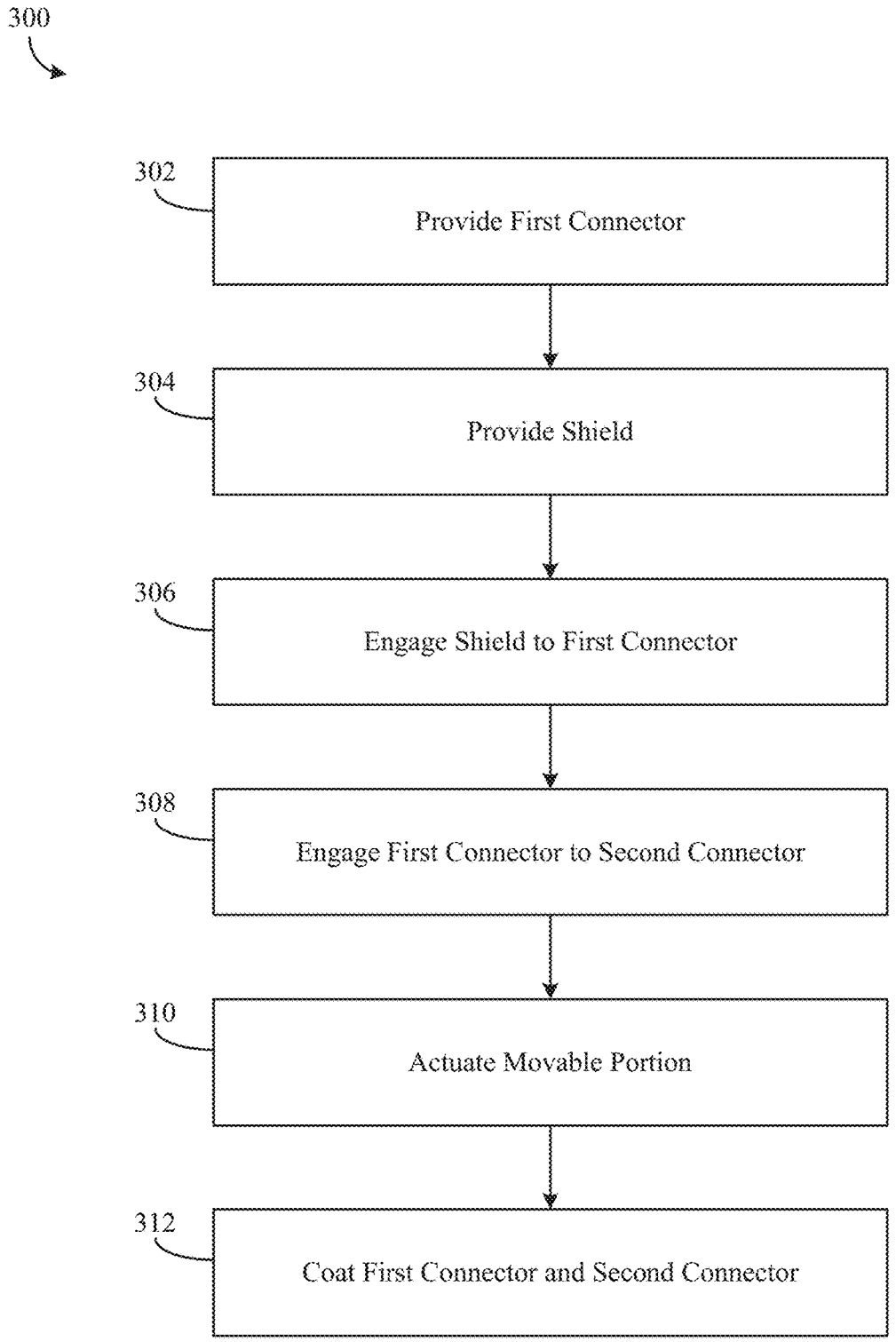
FIG. 3 is a block flow diagram of a method of protecting electrical connectors, according to an example embodiment.

FIG. 3 shows an example of a method 300 of protecting electrical wire connectors using a shield. At 302, a first connector (e.g., the connector 100) is provided. The first connector is associated with one or more electrical wires that lead to or from one or more electrical devices disposed about and/or within an associated internal combustion engine. The first connector also includes at least one moving portion (e.g., the locking tab 108).

At 304, a shield (e.g., the shield 202) is formed or provided. The shield may be formed through various manufacturing processes (e.g., injection molding, 3D printing, casting, etc.). The shield may include one or more of various materials such as plastics, metals, or alloys. The shield is configured to removably engage with an electrical wire connector (e.g., the connector 100) to cover a portion of the at least one moving portion (e.g., the locking tab 108) of the first connector.

At 306, the shield is engaged to the first connector. The shield is engaged to the first connector in a manner that covers the at least one moving portion of the first connector that may be subject to obstructions and/or seizing due to debris or other material, such as paint or other coating. For example, where the first connector includes a locking tab (e.g., the locking tab 108) configured to translate into and out of a locking device (e.g., the locking device 106), the shield may be engaged to cover an area that includes at least a portion of the locking tab to be inserted into the locking device. The shield may be engaged to the first connector via one or more clips, clamps, adhesives, or the like.

At 308, the first connector is engaged to a mating connector. The first connector (e.g., the connector 100) and the mating connector (e.g., a connector that is complementary to the connector 100) are each disposed at a terminal end of respective sets of one or more electrical wires. The first connector and the mating connector are each configured to removably engage the other, thereby electrically bridging each respective set of one or more electrical wires. For example, the first connector may include a socket, which may be engaged with a corresponding plug at the mating connector.

At 310, where the moving portion is a part of a locking device, the moving portion is actuated to engage the locking device. The moving portion may be actuated by, for example, causing the locking tab to linearly translate from a first position to a second position that secures the first connector to mating connector engagement (e.g., by sliding the locking tab into the locking device). In some such arrangements, translating the locking tab into the second position results in most or all of the locking tab being covered by the shield.

At 312, the first connector and the mating connector are coated. The first connector and the mating connector may be coated with a coating material such as paint, clear coat, and/or other aesthetic or protective material that may be sprayed, brushed, or otherwise dispersed over an external area of the connectors. In some implementations, the shield engaged to the first connector at 306 is coated as well. The shield protects the moving portion of the first connector from the coating material, thereby preventing the moving portion from being clogged or seized after coating at 310. In other implementations, the first connector and/or mating connector are not coated, but another component and/or portion of an application into which the engine is being utilized is coated (e.g., painting and/or applying clear coat to a body panel, engine bay, etc.).

Figure 4A:
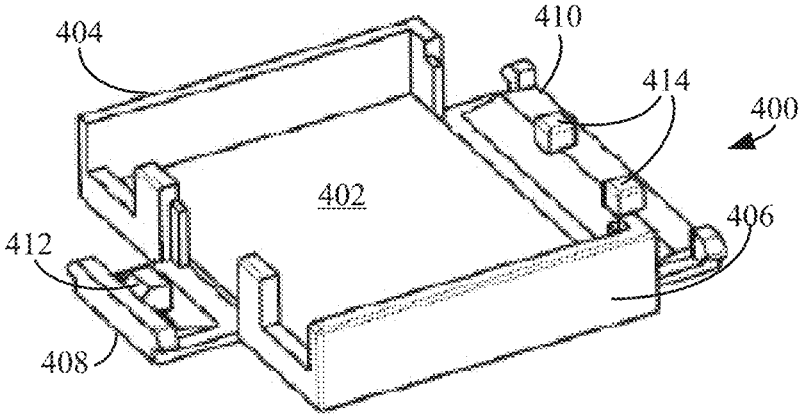
FIG. 4A is a perspective view of an implementation of a shield of FIG. 2A.
Figure 4B:
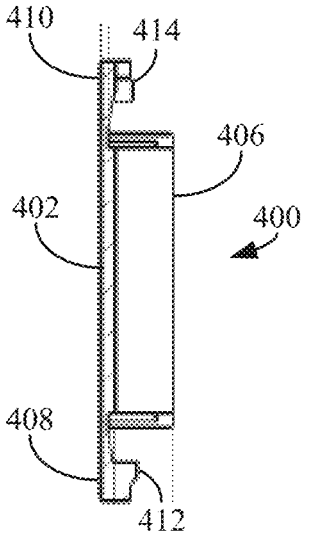
FIG. 4B is a side elevation view of the shield of FIG. 4A.
Figure 4C:
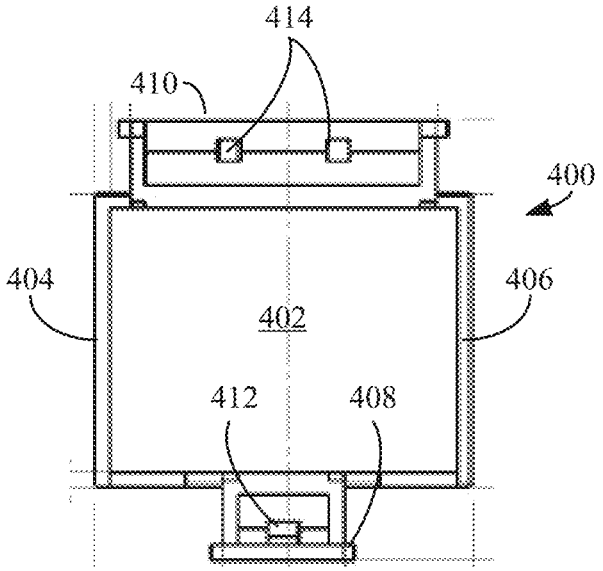
FIG. 4C is a top plan view of the shield of FIG. 4A.

FIGS. 4A-4C depict an implementation of a shield 400 for use with a connector such as connector 100 of FIGS. 1-2C, according to an embodiment of the present disclosure. The shield includes a top cover 402, a first sidewall 404, a second side wall 406, a first connecting portion 408, and a second connecting portion 410. The first sidewall 404 and second sidewall 406 extend from the top cover 402, such as perpendicular (or at another angle) from a plane in which the top cover 402 lies. In some implementations, the first sidewall 404 or the second sidewall 406 may include an opening or slot (such as aperture 204 shown in FIG. 2C) sized to permit a locking tab (such as locking tab 108 shown in FIG. 2C) to extend therethrough, thereby allowing the locking tab to be moved to the first position in which the connector engagement is not secured (e.g., by pulling or sliding the locking tab away from and out of the locking device), or to the second position, where the connector engagement is secured (e.g., by pushing or sliding the locking tab towards and into the locking device), while the shield 400 is coupled to the connector (e.g., connector 100 shown in FIGS. 1-2C). The first connecting portion 408 is elastically or otherwise hingedly coupled to the top cover 402 to permit the first connecting portion 408 to be moved from a first unengaged position in which the first connecting portion 408 lies substantially parallel to the top cover 402 to a first engaged position in which the first connecting portion 408 is non-parallel to the top cover 402, such as perpendicular to the top cover 402, when the first connecting portion 408 is coupled to the connector. The first connecting portion 408 includes one or more first latches 412 to latch and/or otherwise clip or connect to a portion of the connector. For instance, the one or more first latches 412 may latch to a ledge or other protrusion from the connector. In other implementations, the first connecting portion 408 may include other features to removably connect to the connector. The second connecting portion 410 is elastically or otherwise hingedly coupled to the top cover 402 to permit the second connecting portion 410 to be moved from a second unengaged position in which the second connecting portion 410 lies substantially parallel to the top cover 402 to a second engaged position in which the second connecting portion 410 is non-parallel to the top cover 402, such as perpendicular to the top cover 402, when the second connecting portion 410 is coupled to the connector. The second connecting portion 410 includes one or more second latches 414 to latch and/or otherwise clip or connect to a portion of the connector. For instance, the one or more second latches 414 may latch to a ledge or other protrusion of the connector 100. In other implementations, the second connecting portion 410 may include other features to removably connect to the connector.

In some implementations, the connector (e.g., the connector 100) may be coupled to a mating connector and the locking tab (e.g., the locking tab 108) is moved from the first position to the second position (such as shown in FIGS. 2A-2B) to lock the connector to the mating connector. The shield 400 may then be coupled to the connector to cover the locking device (e.g., the locking device 106 of FIGS. 1-2C) and/or the locking tab (e.g., locking tab 108 of FIGS. 1-2C). The shield 400 is coupled to the connector (e.g., connector 100) by latching the one or more first latches 412 to a portion of the connector by moving the first connecting portion 408 from the first unengaged position to the first engaged position to engage the one or more first latches 412 with a portion of the connector. The shield 400 is further coupled to the connector by latching the one or more second latches 414 to a portion of connector by moving the second connecting portion 410 from the second unengaged position to the second engaged position to engage the one or more second latches 414 with a portion of the connector. Thus, shield 400 is removably coupled or engaged with the first connector 400 and the top cover 402 and the first and second sidewalls 404, 406 limit debris and/.or other material (e.g., paint and/or clear coat material) from interfering with the operation of the moving portion of the connector, such as the locking tab.

In implementations where one of the first or second sidewall 404, 406 include an opening or slot (such as aperture 204 shown in FIG. 2C) for the locking tab to protrude through (such as for the locking tab 108 shown in FIG. 2A to protrude through), the shield 400 may be coupled to the connector (e.g., the connector 100) to cover the locking device (e.g. the locking device 106) and/or a portion of the locking tab (e.g., the locking tab 108) prior to the connector being coupled to a mating connector. The shield 400 is coupled to the connector by latching the one or more first latches 412 to a portion of connector by moving the first connecting portion 408 from the first unengaged position to the first engaged position to engage the one or more first latches 412 with a portion of the connector. The shield 400 is further coupled to the connector by latching the one or more second latches 414 to a portion of connector by moving the second connecting portion 410 from the second unengaged position to the second engaged position to engage the one or more second latches 414 with a portion of the connector. The connector may then be coupled to the mating connector and the locking tab may be moved from the first position to the second position to lock the connector to the mating connector, such as shown for the connector 100 in FIGS. 2A-2B. Thus, shield 400 is removably coupled or engaged with the first connector 400 and the top cover 402, and the first and second sidewalls 404, 406 limit debris and/or other material (e.g., paint and/or clear coat material) from interfering with the operation of the moving portion of the connector, such as the locking tab.

For the purpose of this disclosure, the terms "coupled" and "engaged" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various components may differ according to other exemplary embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various components, values of parameters, mounting arrangements, use of materials, colors, orientations, etc.) without materially departing from the novel teachings and advantages of the subject matter disclosed. For example, components shown as integrally formed may be constructed of multiple parts or components, the position of components may be reversed or otherwise varied, and the nature or number of discrete components or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that, unless otherwise noted, any parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way unless otherwise specifically noted. Accordingly, embodiments may be constructed in which acts are performed in an order different than illustrated, which may include performing some acts simultaneously, even though shown as sequential acts in illustrative embodiments.

The claims should not be read as limited to the described order or components unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

What is claimed is:

1. An electrical wire connector, comprising:

a connector body having a first end engageable with one or more electrical wires and a second end removably engageable with a complementary end of a mating connector, the one or more electrical wires electrically bridgeable to one or more wires of the complementary connector when the connector body is engaged with the complementary connector;

a movable portion configured to selectively secure an engagement between the connector body and the complementary end of the mating connector, the moveable portion comprising a locking tab configured to move in and out of the moveable portion; and a shield removably engaged to the connector body to cover a portion of the movable portion.

2. The electrical wire connector of claim 1, wherein the locking tab is movable from a first position to a second position, wherein a first portion of the locking tab is covered by the shield when the locking tab is in the first position, and a second portion of the locking tab is covered by the shield when the locking tab is in the second position.

3. The electrical wire connector of claim 2, wherein the second portion is larger than the first portion.

4. The electrical wire connector of claim 1, wherein a portion of the locking tab is linearly translatable into a locking device of the connector body.

5. The electrical wire connector of claim 1, wherein the locking tab is rotatable about an axis extending perpendicularly from the connector body.

6. The electrical wire connector of claim 1, wherein the locking tab is pivotable about a pivot point disposed on the connector body.

7. The electrical wire connector of claim 1, wherein the shield is removably engaged to the connector body via at least one clip.

8. The electrical wire connector of claim 1, wherein the shield is engaged to the connector body via an adhesive.

9. A method of protecting an electrical wire connector, the method comprising:

providing a shield removably engageable to a connector body of an electrical wire connector;

engaging the shield to the connector body at a location such that the shield covers a movable portion of the connector body; and coating the electrical wire connector with a coating material, the shield blocking the coating material from being applied to the movable portion, wherein the movable portion comprises a locking tab movable from a first position to a second position, and wherein a first portion of the locking tab is covered by the shield when the locking tab is in the first position, and a second portion of the locking tab is covered by the shield when the locking tab is in the second position.

10. The method of claim 9, wherein the second portion is larger than the first portion.

11. A method of protecting an electrical wire connector, the method comprising:

providing a shield removably engageable to a connector body of an electrical wire connector;

engaging the shield to the connector body at a location such that the shield covers a movable portion of the connector body; and coating the electrical wire connector with a coating material, the shield blocking the coating material from being applied to the movable portion, wherein the moveable portion comprises a locking tab, and wherein a portion of the locking tab is linearly translatable into a locking device of the connector body.

12. A method of protecting an electrical wire connector, the method comprising:

providing a shield removably engageable to a connector body of an electrical wire connector;

engaging the shield to the connector body at a location such that the shield covers a movable portion of the connector body; and coating the electrical wire connector with a coating material, the shield blocking the coating material from being applied to the movable portion, wherein the moveable portion comprises a locking tab, and wherein the locking tab is rotatable about an axis extending perpendicularly from the connector body.

13. A method of protecting an electrical wire connector, the method comprising:

providing a shield removably engageable to a connector body of an electrical wire connector;

engaging the shield to the connector body at a location such that the shield covers a movable portion of the connector body; and coating the electrical wire connector with a coating material, the shield blocking the coating material from being applied to the movable portion, wherein the moveable portion comprises a locking tab, and wherein the locking tab is pivotable about a pivot point disposed on the connector body.

14. A method of protecting an electrical wire connector, the method comprising:

providing a shield removably engageable to a connector body of an electrical wire connector;

engaging the shield to the connector body at a location such that the shield covers a movable portion of the connector body; and coating the electrical wire connector with a coating material, the shield blocking the coating material from being applied to the movable portion, wherein the shield is removably engaged to the connector body via at least one clip.

15. A method of protecting an electrical wire connector, the method comprising:

providing a shield removably engageable to a connector body of an electrical wire connector;

engaging the shield to the connector body at a location such that the shield covers a movable portion of the connector body; and coating the electrical wire connector with a coating material, the shield blocking the coating material from being applied to the movable portion, wherein the shield is engaged to the connector body via an adhesive.

16. An assembly, comprising:

a connector including:

a connector body having a first end engageable with one or more electrical wires and a second end removably engageable with a complementary connector, the one or more electrical wires electrically bridgeable to one or more wires of the complementary connector when the connector body is engaged with the complementary connector;

a locking device to selectively lock the connector body of the connector to the complementary connector; and a locking tab movable from a first position to a second position, the connector body of the connector not selectively locked to the complementary connector when the locking tab is in the first position, and the connector body selectively locked to the complementary connector when the locking tab is in the second position; and a shield removably connectable to the connector body to cover the locking tab and the locking device of the connector, the shield including:

a top cover;

a first sidewall extending from the top cover;

a second sidewall extending from the top cover;

a first connecting portion hingedly coupled to the top cover to move from a first unengaged position for the first connecting portion relative to the top cover to a first engaged position for the first connecting portion relative to the top cover; and a second connecting portion hingedly coupled to the top cover to move from a second unengaged position for the second connecting portion relative to the top cover to a second engaged position for the second connecting portion relative to the top cover;

the first connecting portion and the second connecting portion removably connecting the shield to the connector body when the first connecting portion is in the first engaged position relative to the top cover and the second connecting portion is in the second engaged position relative to the top cover.

17. The assembly of claim 16, wherein the first connecting portion includes one or more first latches and the second connecting portion includes one or more second latches.

* * * * *